US009035935B2

(12) United States Patent
Kawano

(10) Patent No.: US 9,035,935 B2
(45) Date of Patent: May 19, 2015

(54) DISPLAY APPARATUS AND DRIVING METHOD FOR DISPLAY APPARATUS

(71) Applicant: CANON KABUSHIKI KAISHA, Tokyo (JP)

(72) Inventor: Fujio Kawano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 171 days.

(21) Appl. No.: 13/866,531

(22) Filed: Apr. 19, 2013

(65) Prior Publication Data

US 2013/0278586 A1 Oct. 24, 2013

(30) Foreign Application Priority Data

Apr. 23, 2012 (JP) ..... 2012-098113

(51) Int. Cl.
*G09G 5/00* (2006.01)
*G09G 3/32* (2006.01)

(52) U.S. Cl.
CPC ..... *G09G 5/001* (2013.01); *G09G 3/3233* (2013.01); *G09G 3/3291* (2013.01); *G09G 2300/0465* (2013.01); *G09G 2300/0819* (2013.01); *G09G 2300/0842* (2013.01); *G09G 2320/0233* (2013.01)

(58) Field of Classification Search
CPC ..... G09G 3/32; G09G 3/3233; G09G 5/00
See application file for complete search history.

(56) References Cited

U.S. PATENT DOCUMENTS

| | | | | |
|---|---|---|---|---|
| 2003/0030603 | A1 | 2/2003 | Shimoda | |
| 2008/0218453 | A1 * | 9/2008 | Miyamoto et al. | 345/76 |
| 2011/0164010 | A1 * | 7/2011 | Yamamoto et al. | 345/207 |
| 2013/0278587 | A1 * | 10/2013 | Kawano | 345/212 |

FOREIGN PATENT DOCUMENTS

| | | | |
|---|---|---|---|
| CN | 1363916 | A | 8/2002 |
| CN | 101116129 | A | 1/2008 |
| CN | 101281720 | A | 10/2008 |
| JP | 2003-140613 | A | 5/2003 |
| JP | 2003-271095 | A | 9/2003 |
| JP | 2008-216872 | A | 9/2008 |
| JP | 2011-141418 | A | 7/2011 |

* cited by examiner

*Primary Examiner* — Andrew Sasinowski
(74) *Attorney, Agent, or Firm* — Canon USA Inc IP Division

(57) ABSTRACT

There are provided for each column of pixels, a detecting unit which detects a voltage between a gate and a source of a drive transistor when a predetermined current is fed to the drive transistor and a unit which adds a data voltage to the voltage supplied by the detecting unit and supplies a sum to a data line.

9 Claims, 5 Drawing Sheets

DISPLAY APPARATUS AND DRIVING METHOD FOR DISPLAY APPARATUS

BACKGROUND OF THE INVENTION

1. Field of the Invention

The present disclosure relates to display apparatuses, driving devices for light emitting devices and image forming apparatuses, and it particularly relates to display apparatuses including an organic electroluminescent (EL) element and a drive circuit therefor.

2. Description of the Related Art

In recent years, demands for higher resolutions of active matrix display apparatuses including light emitting devices such as organic EL elements have risen, and the area that may be assigned to one pixel has been reduced therefor. The area to be assigned to a pixel has a light emitting device and a drive circuit which drives the light emitting device. Thus, the reduced area that may be assigned to one pixel may reduce the area to be assigned to the drive circuit. This may require the drive circuit configured with as few circuit elements as possible.

The drive circuit includes a transistor (hereinafter, called a drive transistor) which controls the amount of current to be supplied to the light emitting device in accordance with an image signal. However, transistors vary in their electric characteristics due to their manufacturing processes. Particularly, thin film transistors having been used widely vary largely in their threshold values and/or mobilities. This may cause different amounts of current to be supplied to the light emitting devices even in response to a same image signal in a display apparatus employing thin film transistors as the drive transistors, resulting in display unevenness and thus deteriorating its display quality.

According to Japanese Patent Laid-open No. 2003-140613, the current fed to a light emitting device is amplified by a current mirror circuit and is fed back to a data-side drive circuit, and the feedback current and a reference current having luminance information are compared. Then, the current to be fed to the light emitting device is controlled to be a drive current having a desirable luminance.

Japanese Patent Laid-open No. 2003-271095 discloses a drive circuit which generates current independent of the threshold voltage of a drive transistor. Before data voltage is written, a current path between the drive transistor and the light emitting device is blocked, and a short circuit is created between its gate and drain. Thus, the drain current of the drive transistor discharges the gate-source capacitor and thus gradually reduces the gate-source voltage. When the gate-source voltage gets to be equal to the threshold voltage of the drive transistor, the drain current is equal to 0. This holds the threshold voltage in the capacitor. Such an operation in which current fed to a transistor brings a gate-source voltage to a threshold voltage of the transistor is called auto-zero.

In order to write a data voltage to a drive circuit with auto-zero when a gate-source capacitor of the drive transistor holds a threshold voltage, the voltage of the data line is changed from a reference voltage to the data voltage, and the voltage change on the data line is transmitted to a gate of the drive transistor through a different capacitor connected to between the gate and the data line. This changes the voltage across the gate-source capacitor from the threshold voltage by the amount equal to the voltage proportional to the voltage change on the data line. The gate-source voltage after the change exhibits a value including the addition of the change proportional to the data voltage to the threshold voltage. This provides a drain current independent of the threshold voltage.

According to Japanese Patent Laid-open No. 2003-140613, a data-side drive circuit is provided for each data line and is shared by a plurality of pixels, eliminating the necessity for a data-side drive circuit for each pixel. Instead, it may require the current (monitor current) acquired by amplifying the current fed to each light emitting device to be fed back to a data-side drive circuit through a data line. When the monitor current is minute current, it is influenced by parasitic capacitance of the data line, which may require time for detection and/or correction the minute current. The drive circuit may possibly become bloated when higher amplification efficiency by a current mirror circuit for higher monitor current are attempted to obtain.

A pixel circuit performing an auto-zero operation according to Japanese Patent Laid-open No. 2003-271095 has two of a gate-source capacitor and a gate-data line capacitor. This increases the area of occupation of the capacitors on the display substrate and reduces the pixel size, making it difficult to provide a high-definition display apparatus.

SUMMARY OF THE INVENTION

An embodiment of the present invention provides an organic EL apparatus which may provide high-definition and high-quality image display by correcting variations in electric characteristics of drive transistors therein, without increasing the number of circuit elements included in a drive circuit therein.

A display apparatus according to an embodiment of the present invention includes pixels arranged in a matrix form, a data line and a feedback line provided for each column of the pixels, and a column control circuit connected to the data line and feedback line. In this case, a light emitting device and a drive circuit which drives the light emitting device are provided for each of the pixels. The drive circuit has a drive transistor which controls current to be fed to the light emitting device. The column control circuit has a detecting circuit which detects a voltage between a gate and a source of the drive transistor when a predetermined current is fed to the drive transistor, and a unit which adds a data voltage to a voltage supplied by the detecting circuit and supplies a sum to the data line.

Further features of the present invention will become apparent from the following description of exemplary embodiments with reference to the attached drawings.

DESCRIPTION OF THE EMBODIMENTS

Figure 1:
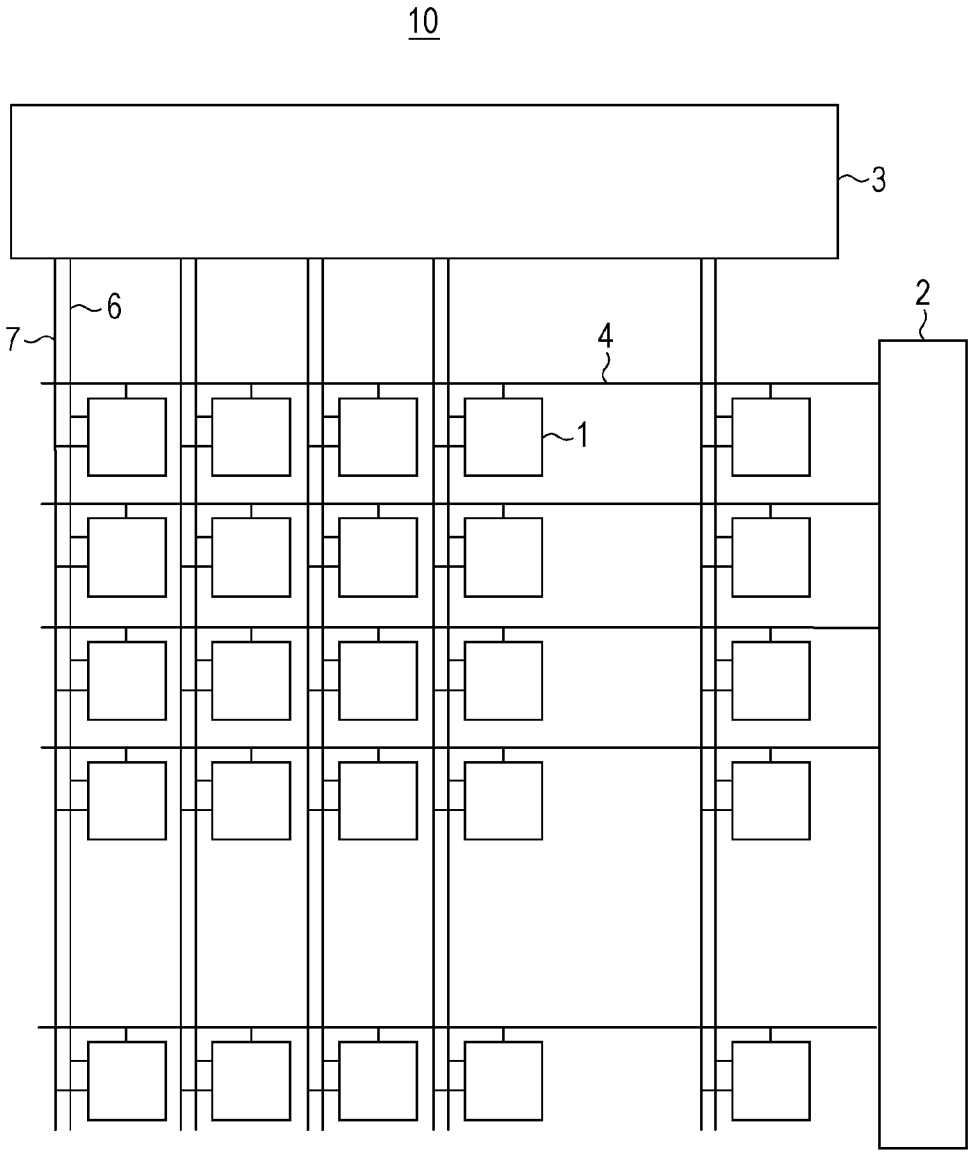
FIG. 1 is a block diagram illustrating a configuration example of a display apparatus according to the present invention.

FIG. 1 is a block diagram illustrating a configuration example of a display apparatus according to an embodiment of the present invention. A matrix display apparatus 10 displays with a plurality of pixels 1 arranged in a row direction and a column direction. Each of the pixels 1 includes a light emitting device and a drive circuit (pixel circuit) which drives the light emitting device. Three types of red (R), green (G), and blue (B) light emitting devices are provided in a color display apparatus and are arranged periodically in a row direction. The light emitting devices may be organic EL elements or may be inorganic EL elements or LEDs.

The pixels 1 are controlled by a scan line 4 extending in a row direction and a data line 6 and a feedback line 7 extending in a column direction. The scan line 4 receives a signal from a row control circuit 2 and controls the pixels 1 between a write mode and a light-emitting mode, for example. A data signal for determining a light emission state of the pixels 1 is generated within a column control circuit 3 and is written to the pixels 1 in the write mode through the data line 6. The pixels 1 in the light emission mode emit light in accordance with a luminance signal written therein.

Figure 2:
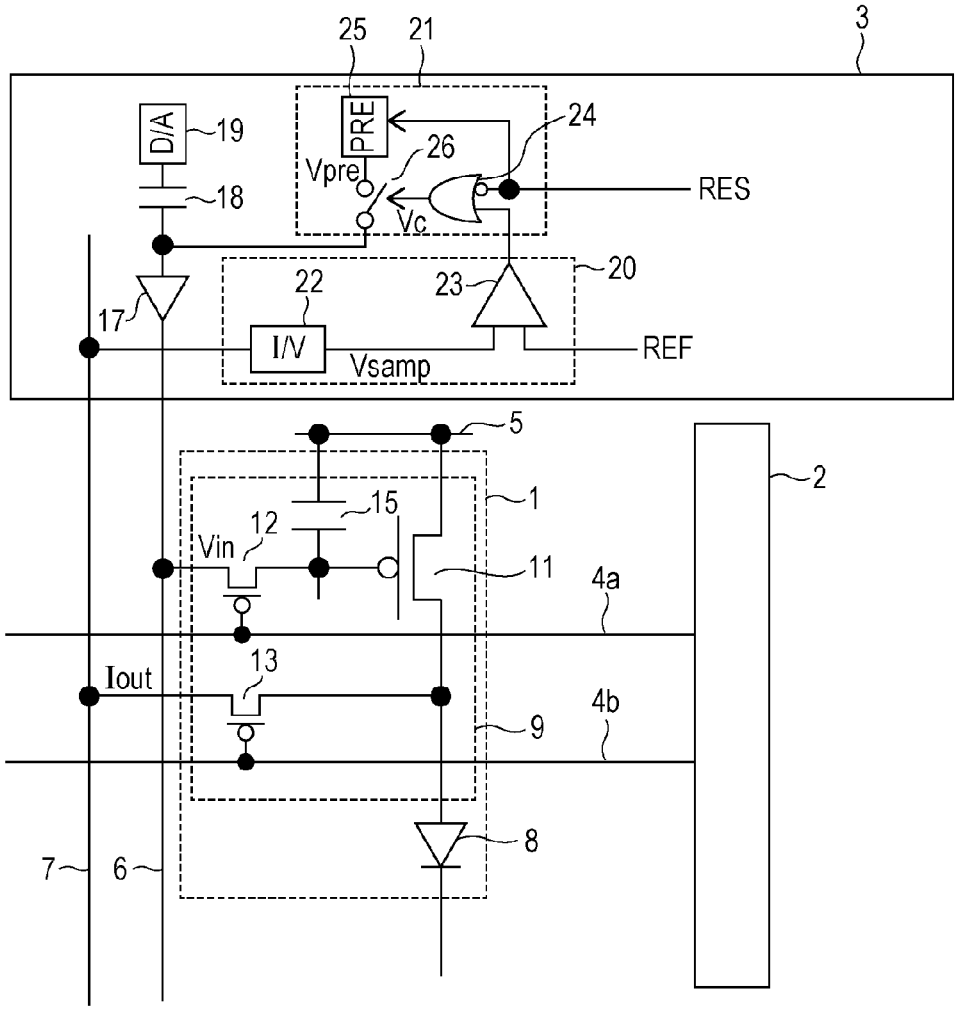
FIG. 2 illustrates a connection example of a drive circuit and a column control circuit in a display apparatus according to an embodiment of the present invention.

FIG. 2 illustrates one column of the matrix display apparatus 10 in FIG. 1 and illustrates details of a pixel circuit and how the data line 6 and the feedback line 7 are connected to the column control circuit 3. Like numbers refer to like elements throughout.

The drive circuit 9 includes three p-channel type field-effect transistors 11, 12, and 13 and a pixel capacitor 15 which stores or holds a data voltage. A scan line 4*a* which controls the transistor 12, a scan line 4*b* which controls transistor 13, the data line 6, a reference voltage line 7, and a power supply line 5, not illustrated in FIG. 1 are connected to the drive circuit 9.

The transistor 11 has a source electrically connected to the power supply line 5 and one end of the pixel capacitor 15 and a drain connected to an anode electrode of the light emitting device 8 and the feedback line 7 through the transistor 13. The transistor 11 has a gate connected to the other end of the pixel capacitor 15 and the data line 6 through the transistor 12. A current (drain current) determined in accordance with the gate-source voltage held in the pixel capacitor 15 is output from the drain and is supplied to the light emitting device 8. The transistor 11 functions as a drive transistor which control the amount of current to be supplied to the light emitting device in accordance with an image signal.

The transistor 12 between the data line 6 and a gate of the drive transistor 11 functions as a switch (first switch) for transmitting a voltage of the data line 6 to the gate of the drive transistor 11. The transistor 13 between the feedback line 7 and a drain of the drive transistor 11 functions as a switch (second switch) for feeding a drain current of the drive transistor 11 to the feedback line 7 when the transistor 12 has an ON state.

The column control circuit 3 has a plurality of sets of circuit blocks 17, 19, 20, and 21 provided for each pixel column and one capacitor 18. The circuit block 19 functions as a data generation circuit which generates data voltage, and the circuit block 17 functions as a voltage amplifier. The circuit block 20 functions as a current detecting unit which detects a current Iout output from the drive circuit 9 through the feedback line 7. The circuit block 21 functions as a voltage scanning unit which scan a voltage in a predetermined range and outputs it to the pixel circuit in order to identify the gate-source voltage of the drive transistor 11 when the current detected by the current detecting block 20 is equal to a predetermined value. The capacitor 18 is a coupling capacitor which transmits an output of the data generation circuit 19 to the voltage amplifier 17.

The data voltage generated by the data generation circuit 19 may be added a voltage output from the voltage scanning block 21, and the sum may be output to the data line 6 through the voltage amplifier 17.

An outline of a method for programming a pixel circuit according to an embodiment of the present invention will be described.

It is assumed that the transistors 12 and 13 in the drive circuit pix(n) to be programmed in the nth row of the drive circuits included in one pixel column are turned on. The output voltage of the data generation circuit 19 is fixed to a voltage corresponding to a gate-source voltage Va where a drain current of the drive transistor is equal to 0. Once the voltage output from an output terminal Vpre of the voltage scanning block 21 is set to a voltage corresponding to a gate-source voltage when the drain current of the drive transistor is equal to 0, the voltage value is scanned in the increasing direction of the drain current. The voltage value of the output terminal Vpre may be scanned in the decreasing direction of the drain current from the voltage with a maximum drain current.

(Va+Vpre) is input to a gate of the drive transistor in the drive circuit pix(n) through the data line 6, and the drain current according to the gate-source voltage is output to the feedback line 7 and is input as the detected current Iout to the current detecting block 20. The current detecting block 20 outputs a signal to stop scanning by the voltage scanning block 21 when the detected current Iout gets to be equal to a predetermined current. This operation is performed for obtaining a same state among the drive circuits before an image signal is written to the drive circuits, which corresponds to a threshold value or mobility correction operation by the prior art. The predetermined current with which the detected current Iout is compared may be determined arbitrarily as far as it is a common current value among the drive circuits for reducing the characteristic variations among the drive transistors in a display apparatus.

After the voltage when the voltage scanning block 21 receives the signal to stop scanning from the current detecting block 20 is held in a parasitic capacitance or the capacitor 18, the transistor 13 is turned off. Next, the data voltage is output from the data generation circuit 19 in accordance with an image signal, and a voltage held in a parasitic capacitance of the scan signal data line or in the capacitor 18 and added the data voltage is input to the drive circuit and is written to the gate of the drive transistor. After the programming on the drive circuit pix(n) completes, the transistor 12 is turned off. The transistors 12 and 13 in the drive circuit pix(n+1) in the (n+1)th row to be programmed are turned on, and the same programming as that on the pix(n) is performed.

Next, the circuit configurations of the current detecting block 20 and voltage scanning block 21 will be described in detail.

The current detecting block 20 includes a current-voltage conversion circuit 22 and a comparator 23, and the voltage scanning block 21 includes an adding circuit 24, a voltage scanning circuit 25, and a switch 26.

The feedback line 7 is connected to the current-voltage conversion circuit (I/V) 22, and a detected current Iout output from the drive circuit is converted to a voltage in the current-voltage conversion circuit 22. An output terminal Vsamp of the current-voltage conversion circuit 22 is input to one end of the comparator 23, and a reference voltage REF is input to the other end of the comparator 23.

The reference voltage REF is a voltage for obtaining a same state among a plurality of pixel circuits having drive transistors with different electric characteristics from each other. The value of the reference voltage REF may be selected arbitrarily independent of a data voltage. The reference voltage REF may be fixed to a common value to all current-voltage conversion circuits 22 while data voltage for at least one screen is being programmed, and the reference voltage REF may be changed for each screen. For example, when the average luminance of the displayed screen is high, the reference voltage REF may be set high. When the average luminance is low, the reference voltage REF may be set low. Thus, the characteristic variations in the threshold values and/or mobilities of the drive transistors included in pixels may be reduced more. The comparator 23 outputs High (H) if the output voltage of the output terminal Vsamp is smaller than the reference voltage REF and outputs Low (L) if not.

An output of the comparator 23 is input to one end of the adding circuit 24, and a control signal RES is input to the other end of the adding circuit 24. An output terminal Vc of the adding circuit 24 is connected to a control terminal of the switch 26. The output terminal Vc of the adding circuit 24 outputs H if the comparator 23 outputs H and outputs L if not.

One end of the switch 26 is connected to the voltage scanning circuit 25, and the other end of the switch 26 is connected to the capacitor 18 and voltage amplifier 17. The voltage scanning circuit 25 receives the control signal RES. The switch 26 is brought into conduction if the output terminal Vc outputs H and shuts down if it outputs L. In this case, the voltage of the output terminal Vpre of the block 21 is scanned in the increasing direction of the drain current from the voltage corresponding to the gate-source voltage when the drain current of the drive transistor is equal to 0. Accordingly, if it is detected that the output Vsamp reaches the reference voltage REF, the other end of the capacitor 18 to be turned off by the switch 26 is connected to the output of the data generation circuit 19, and the output of the voltage amplifier 17 is connected to the data line. When the voltage value of the output terminal Vpre is scanned in the decreasing direction of the drain current from the voltage when the drain current is at a maximum, it is detected that the output Vsamp has reached the reference voltage REF, and the switch 26 is thus turned on.

Figure 3:
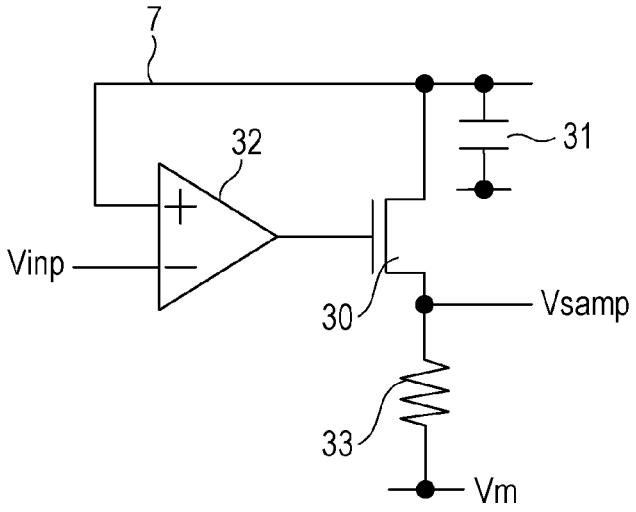
FIG. 3 illustrates a specific circuit configuration example of a current-voltage conversion circuit.

FIG. 3 illustrates a concrete example of the current-voltage conversion circuit 22 which includes a transistor 30, a capacitor 31, an operational amplifier 32, and a resistor 33. The positive side of the operational amplifier 32 is connected to the feedback line 7, and the negative side receives a reference voltage Vinp. An output of the operational amplifier 32 is input to a gate of the transistor 30, and a drain of the transistor 30 is connected to the feedback line 7. The capacitor 31 is connected to the feedback line 7. However, because a parasitic capacitance occurs in the feedback line 7, the capacitance may be used instead. A source of the transistor 30 is connected to the resistor 33 and is connected to the output terminal Vsamp. The resistor 33 has the other end connected to a predetermined voltage Vm.

If the voltage of a terminal (feedback line terminal) connecting to the feedback line 7 of the operational amplifier 32 is higher than Vinp, the operational amplifier 32 outputs higher voltage, and the transistor 30 has high gate-source voltage Vgs. With the higher Vgs, higher current is fed to the transistor 30, and the capacitor 31 is discharged. Thus, the terminal Voltage of the feedback line 7 falls.

If the feedback line terminal Voltage is lower than Vinp, the operational amplifier 32 outputs lower voltage, and the transistor 30 has lower Vgs. With the Vgs, lower current is fed to the transistor 30, and the capacitor 31 is charged. Thus, the terminal Voltage of the feedback line rises. This operation may control such that the terminal Voltage of the feedback line may keep equal to the voltage Vinp at all times. Setting the voltage Vinp to a voltage with which the light emitting device 6 does not emit light may control the light emitting device 6 so as not to emit light when the transistor 13 has an ON state. The current voltage conversion circuit is not limited to have the configuration in FIG. 3. For example, the transistor 30 may be of a P channel type, and the positive/negative polarity of the operational amplifier 32 may be inverted (The negative input may be connected to the feedback, and the positive input may receive Vinp). The resistor 33 may only be provided therein if the variations of the potential of the feedback line 7 are not significant.

The resistor 33 converts current input from the feedback line to voltage and outputs it as Vsamp. The voltage Vm is assumed to have lower voltage than the voltage Vref of the feedback line, and the value of the resistance 22 is designed such that a relationship Vsamp>Vref may be kept while the voltage Vm is being detected and the transistor 30 may keep the source-drain voltage Vds for highly accurate detection thereof.

This operation allows detection of the magnitude of the current Tout output from the drive circuit and conversion to the voltage Vsamp corresponding to the current Tout by keeping the feedback line terminal Voltage to have a constant potential.

Figure 4:
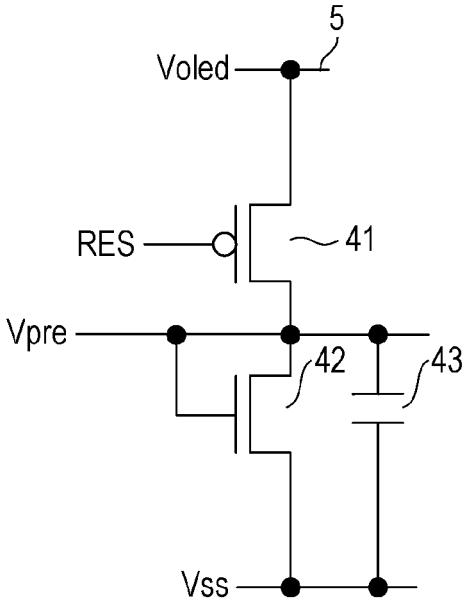
FIG. 4 illustrates a specific circuit configuration example of a voltage scanning circuit.

FIG. 4 illustrates a concrete example of the voltage scanning circuit 25. A p-type transistor 41 has a source connected to the power supply line 5. The p-type transistor 41 further has a drain connected to the output terminal Vpre and a gate connected to the control signal RES. An n-type transistor 42 has a gate and a drain connected to the output terminal Vpre and a source connected to Vss (GND). A capacitor 43 is connected to the output terminal Vpre.

Figure 5:
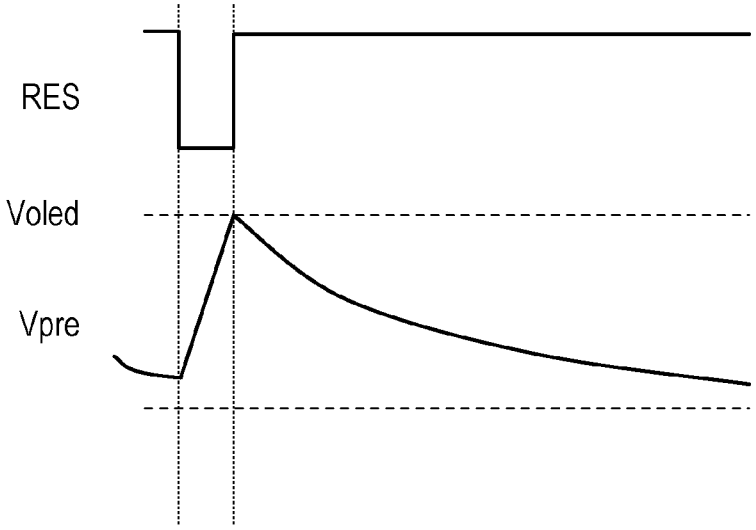
FIG. 5 is a timing chart illustrating an operation of the voltage scanning circuit.

An operation of the circuit will be described with reference to the timing chart in FIG. 5. When the control signal RES has L, the gate of the transistor 41 has L. The transistor 41 is thus turned on, and the output terminal Vpre has an equal potential to a potential Voled of the power supply line (this state will be called a reset state). In this case, the capacitor 43 is charged with a potential difference Voled between Vpre and Vss (GND). When the gate of the transistor 41 shifts from L to H, the transistor 41 is turned off. The current fed in accordance with the gate-source voltage Vgs of the transistor 42 is discharged from the capacitor 43, and the output voltage of the output terminal Vpre falls from Voled. Current is fed to perform the discharging operation until the threshold voltage of the transistor 42 is obtained. In other words, the voltage output from the output terminal Vpre is scanned in a predetermined range from Voled to the threshold voltage of the transistor 42. The scanning time required for scanning the output voltage of the output terminal Vpre depends on the size of the capacitor 43 and/or the ratio (W/L) of the channel width and channel length of the transistor 42. The size of the capacitor 43 or the transistor 42 may be designed such that the detection may be performed within the scanning time according to the design of the display apparatus.

Figure 6:
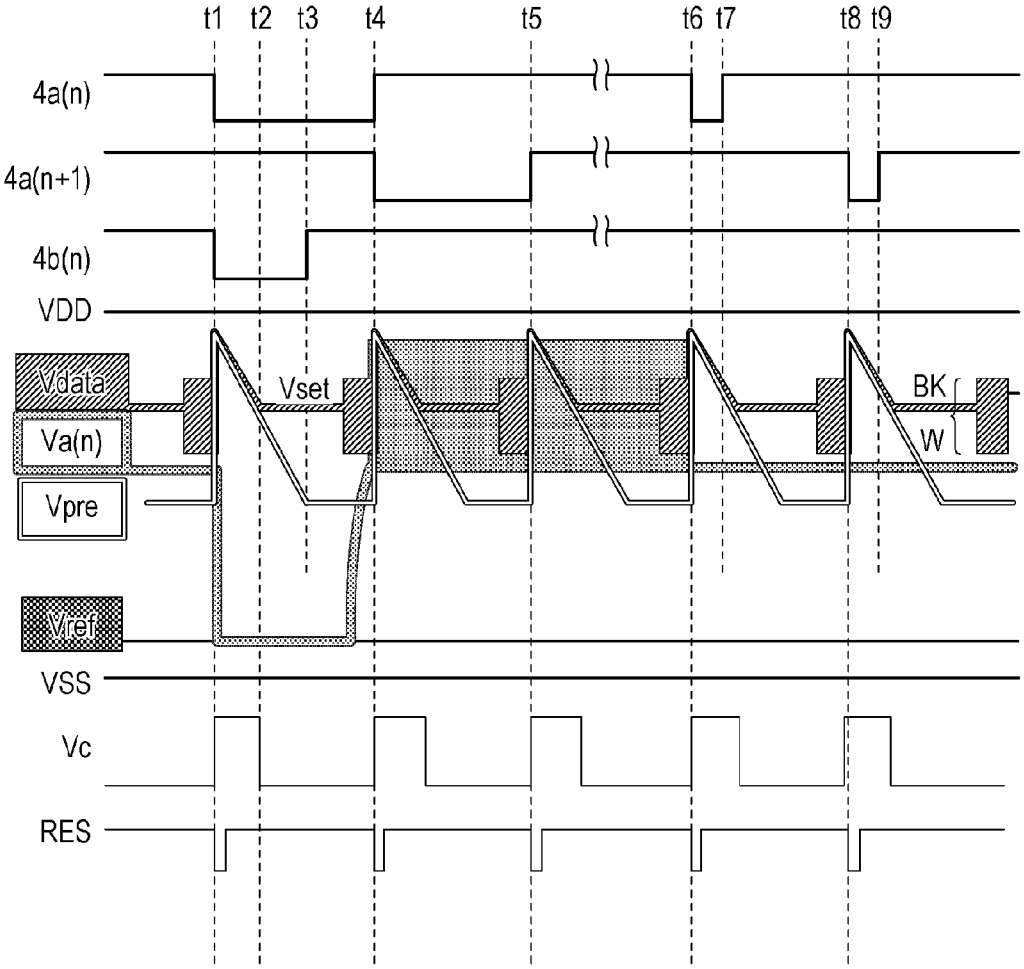
FIG. 6 is a timing chart illustrating an operation of a display apparatus according to an embodiment of the present invention.

Next, there will be described programming on a drive circuit in a display apparatus in which the circuits illustrated in FIGS. 3 and 4 are applied to the circuit in FIG. 2. FIG. 6 is a timing chart illustrating a programming operation on a drive circuit pix(n) in an nth row.

During the period from t1 to t2, the scan lines 4*a*(*n*) and 4*b*(*n*) are shifted to L, and the transistors 12 and 13 are shifted to an ON state. At t1, the control signal RES is shifted to L, and the transistor 41 of the voltage scanning circuit 25 is turned on. The output terminal Vpre of the voltage scanning circuit 25 comes to have an equal potential to the potential Voled of the power supply line 5. After that, the control signal RES is shifted to H, and an output terminal Vc of the adding circuit 24 outputs H, which turns on the switch 26. The output terminal Vc comes to have an H state if the voltage Vsamp(n) of the output terminal of the current-voltage conversion circuit 22 is lower than the reference voltage REF and has an L state if not. The Vsamp(n) is a voltage Vsamp during a programming operation on the nth row.

The voltage Vpre output from the voltage scanning circuit 25 is input to a gate of the drive transistor 11 in the nth pixel through the switch 26 and amplifier 17. At that time, the output of the data generation circuit 19 is set to a fixed potential Vda. The voltage Vinp of the current-voltage conversion circuit 22 is set to a voltage with which the light emitting device 8 does not emit light.

Current of the drive transistor 11 is input to the current-voltage conversion circuit 22 through the feedback line 7, is converted to a voltage Vsamp(n) and is input to one end of the comparator 23. Because Vgs of the drive transistor 11 is substantially equal to 0, the drain current, that is, the detected current Iout(n) is also substantially equal to 0. As a result, the relationship Vsamp(n)<reference voltage REF is satisfied, and the comparator 23 outputs H. The current Iout(n) here is a detected current Tout during a programming operation on the nth row.

After the control signal RES is shifted from L to H, the output voltage Vpre of the voltage scanning circuit 25 falls due to a discharging operation on the capacitor 43 of the voltage scanning circuit 25. With this, Vgs of the drive transistor 11 rises gradually, and the detected current Iout(n) and Vsamp(n) also rise.

When the relationship Vsamp(n)>reference voltage REF is satisfied with the detected current with a certain Vgs, the output of the comparator 23 shifts from H to L, and the output Vc of the adding circuit 24 has an L state, which turns off the switch 26. At that time, the data line 6 has a voltage corresponding to the output Vpre value from the voltage scanning circuit 25 when the switch 26 is turned off. Hereinafter, the voltage at that time will be called voltage Vset(n) below.

During a period from t2 to t3, the data line 6 stores or holds the detected voltage Vset due to the shutdown of the switch 26. The scan line 4*b*(*n*) is shifted from L to H, and the transistor 13 is turned off.

During a period from t3 to t4, the output of the data generation circuit 19 is shifted from the fixed potential Vda to the data voltage Vvideo(n). A low voltage(W) may be set to increase the luminance of the light emitting device, and a high voltage(BK) may be set to reduce it. A difference voltage (Vda−Vvideo(n)) between Vda and Vvideo(n) is added to the voltage Vset stored or held by the data line 7 through the capacitor 18, and Vset(n)−(Vda−Vvideo(n)) is written to a gate of the drive transistor 11(*n*) in the drive circuit to be programmed.

The scan line 4*a*(*n*) is shifted from L to H, and the transistor 12 is turned off. Then, the pixel pix(n) programming operation completes. During the next period t4 to t9, the data line 6 and/or feedback line 7 are used for a programming operation on a pixel pix(n+1). In the programming operation on the pixel pix(n+1), when the relationship Vsamp(n+1)>reference voltage REF is satisfied with a detected current with Vgs, the switch 26 is turned off, and the data line 6 has Vset(n+1), like pixel pix(n). After that, Vset (n+1)−(Vda−Vvideo (n+1)) is written to a gate of the drive transistor 11(*n*+1) in the drive circuit.

In this way, in a programming operation on any pixel pix(n), before a data voltage Vvideo is written, the voltage of the corresponding data line is set to the value of Vre when the voltage corresponding to a detected current Iout is equal to the reference voltage REF, that is, to the voltage Vset. This may allow all of the gate voltages of the drive transistors in pixels to have a state allowing feeding of a predetermined drain current before the programming operation thereon are performed.

During a period from t4 to t6, the voltage Vset−(Vda−Vvideo) is held in the pixel capacitor 15 and functions as the voltage Vgs of the drive transistor 11. The current according to the voltage is supplied to the light emitting device 8 which thus emits light.

During a period from t6 to t7, 4*a*(*n*) is shifted to L, and the transistor 12 is turned on. At that time, because the data line 6 is used by a current detection operation on another drive circuit, the voltage of the data line 6 is close to the voltage Voled. Thus, writing the voltage of the data line 6 to a gate of the drive transistor 11 in the pixel pix(n) may shut off the light emitting device. This sequence may be omitted if the luminance of the light emitting device is adjusted without controlling its duty.

During a period from t8 to t9, a shut-down operation on the pixel pix(n+1) is performed.

Through operations described above may correct variations in electric characteristics of the drive transistors 11 and thus provide high quality image. According to an embodiment of the present invention, the voltage Voled resets the voltage scanning circuit 25. However, for quick detection, it may be changed to a lower voltage than Voled properly (where it is higher than the threshold voltage). Having described that the drive transistor 7 according to the aforementioned embodiment is of p-type, an n-type transistor may be used instead.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-098113 filed Apr. 23, 2012, which is hereby incorporated by reference herein in its entirety.

What is claimed is:

1. A display apparatus comprising:

pixels arranged in a row direction and a column direction;

a data line and a feedback line provided for each column of the pixels; and a column control circuit connected to the data line and feedback line, wherein a light emitting device and a drive circuit which drives the light emitting device are provided for each of the pixels, the drive circuit has a drive transistor which controls current to be fed to the light emitting device, and the column control circuit has a detecting circuit which detects a voltage between a gate and a source of the drive transistor when a predetermined current is fed to the drive transistor, and a unit which adds a data voltage to a voltage supplied by the detecting circuit and supplies a sum to the data line.

2. The display apparatus according to claim 1, wherein the detecting circuit includes a voltage scanning circuit which scans a potential of a predetermined range and supplies it to the unit of the detecting circuit that supplies the sum to the data line.

3. The display apparatus according to claim 1, wherein the detecting circuit has a current-voltage conversion circuit which converts current to be fed to the drive transistor to voltage.

4. The display apparatus according to claim 3, wherein the input to the current-voltage conversion circuit is implemented through the feedback line, and the voltage of the feedback line is controlled to keep a constant voltage.

5. The display apparatus according to claim 1, wherein the detecting circuit has a circuit which supplies voltage output from the voltage scanning circuit to the data line via a switch and turns off the switch when the value of voltage converted from current to be fed to the drive transistor by the current-voltage conversion circuit reaches a predetermined voltage value.

6. The display apparatus according to claim 1, wherein the detecting unit has a comparison unit which compares between a voltage output from the current-voltage conversion circuit and a reference voltage.

7. A display apparatus comprising:

pixels arranged in a row direction and a column direction;

a data line and a feedback line provided for each column of the pixels; and a column control circuit connected to the data line and feedback line, wherein a light emitting device and a drive circuit which drives the light emitting device are provided for each of the pixels, the drive circuit has a drive transistor which controls current to be fed to the light emitting device, a first switch provided between a gate of the drive transistor and the data line, and a second switch provided between a drain of the drive transistor and the feedback line, and the column control circuit turns on the first switch and the second switch, scans a voltage in a predetermined range and outputs it to the data line, detects a voltage when a predetermined current is fed to the drive transistor, turns off the second switch and supplies a sum voltage of the detected voltage and a data voltage to the data line.

8. A method for driving a display apparatus including pixels arranged in a row direction and a column direction, a data line and a feedback line provided for each column of the pixels, and a column control circuit connected to the data line and feedback line, wherein a light emitting device and a drive circuit which drives the light emitting device are provided for each of the pixels, and the drive circuit has a drive transistor which controls current to be fed to the light emitting device, a first switch provided between a gate of the drive transistor and the data line, and a second switch provided between a drain of the drive transistor and the feedback line, the method comprising:

turning on the first switch and the second switch, scanning a voltage in a predetermined range and outputs it to the data line, and detecting a voltage when a predetermined current is fed to the drive transistor; and turning off the second switch and supplying a sum voltage of the detected voltage and a data voltage to the data line.

9. The method for driving the display apparatus according to claim 8, wherein the detecting a voltage when a predetermined current is fed to the drive transistor includes detecting a voltage fed to the predetermined current by comparing with a fixed value that is common to all drive circuits while a data voltage for at least one screen is being programmed.

* * * * *